US009305677B2

(12) United States Patent
Rousseas et al.

(10) Patent No.: US 9,305,677 B2
(45) Date of Patent: Apr. 5, 2016

(54) BORON NITRIDE CONVERTED CARBON FIBER

(71) Applicant: The Regents of the University of California, Oakland, CA (US)

(72) Inventors: Michael Rousseas, Burlingame, CA (US); William Mickelson, Albany, CA (US); Alexander K. Zettl, Kensington, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 14/148,508

(22) Filed: Jan. 6, 2014

(65) Prior Publication Data

US 2014/0197366 A1 Jul. 17, 2014

Related U.S. Application Data

(60) Provisional application No. 61/751,641, filed on Jan. 11, 2013.

(51) Int. Cl.

| | |
|---|---|
| ***H01B 1/04*** | (2006.01) |
| ***D01F 8/18*** | (2006.01) |
| ***D01F 11/12*** | (2006.01) |

(52) U.S. Cl.
CPC .. *H01B 1/04* (2013.01); *D01F 8/18* (2013.01); *D01F 11/124* (2013.01)

(58) Field of Classification Search
CPC ..... H01B 1/04; H01B 13/06; D01F 8/18; D01F 11/124
USPC ..... 252/502, 500
See application file for complete search history.

(56) References Cited

U.S. PATENT DOCUMENTS 5,116,679 A * 5/1992 Nadkarni et al. ..... 428/367
5,368,938 A * 11/1994 Holzl et al. ..... 428/408

FOREIGN PATENT DOCUMENTS

CN 102757025 A * 10/2012
JP 2000109306 A * 4/2000
JP 2004218144 A * 8/2004
JP 2010040883 A * 2/2010

OTHER PUBLICATIONS

Das, M. Basu, A. K., Ghatak, S. Joshi, Amish G. Carbothermal synthesis of boron nitride coating on PAN carbon fiber. J. European Ceramic Soc. 2009, 2129-2134.

Li, Jun-Sheng, Zhang, Chang-Rui, Li, Bin. Preparation and characterization of boron nitride coatings on carbon fibers from borazine by chemical vapor deposition. Applied Surface Science 2011, 257, 7752-7757.

(Continued)

*Primary Examiner* — Mark Kopec
*Assistant Examiner* — Danny N Kang
(74) *Attorney, Agent, or Firm* — Knobbe Martens Olson & Bear LLP

(57) ABSTRACT

This disclosure provides systems, methods, and apparatus related to boron nitride converted carbon fiber. In one aspect, a method may include the operations of providing boron oxide and carbon fiber, heating the boron oxide to melt the boron oxide and heating the carbon fiber, mixing a nitrogen-containing gas with boron oxide vapor from molten boron oxide, and converting at least a portion of the carbon fiber to boron nitride.

20 Claims, 3 Drawing Sheets

(56) References Cited

OTHER PUBLICATIONS

Das, M. Ghosh, J. Basu, A. K. Effect of activation on boron nitride coating on carbon fiber. Ceramics International 2010, 36, 2511-2514.
T.S. Bartnitskaya, M.V. Vlasova, T.Y. Kosolapova, N. V. Kostyuk, I.I. Timofeeva, Porosk. Metall. (Kiev), 12 (1990), p. 55.
A. Aydoğdu, N. Sevinç, Carbothermic formation of boron nitride, Journal of the European Ceramic Society, vol. 23, Issue 16, Dec. 2003, pp. 3153-3161.
Paine, R. T.; Narula, C. K. Synthetic Routes to Boron Nitride. Chem. Rev. 1990, 90, 73-91.
Hubácek, M.; Ueki, M. Chemical Reactions in Hexagonal Boron Nitride System. J. Solid State Chem. 1996, 123, 215-222.
Han, W.; Bando, Y.; Kurashima, K.; Sato, T. Synthesis of Boron Nitride Nanotubes from Carbon Nanotubes by a Substitution Reaction. Appl. Phys. Lett. 1998, 73, 3085-3087.
Han, W.-Q.; Brutchey, R.; Tilley, T. D.; Zettl, A. Activated Boron Nitride Derived from Activated Carbon. Nano Lett. 2004, 4, 173-176.
Cullis, C. F.; Yates, J. Reaction of Carbon with Nitrogen. Trans. Faraday Soc. 1964, 60, 141-148.
Rousseas, M.; Goldstein, A. P.; Mickelson, W.; Worsley, M. A.; Woo, L.; Zettl, A. Synthesis of Highly Crystalline sp2-Bonded Boron Nitride Aerogels. ACS Nano 2013, 7, 8540-8546.

* cited by examiner

BORON NITRIDE CONVERTED CARBON FIBER

RELATED APPLICATIONS

This application claims priority to U.S. Provisional Patent Application No. 61/751,641, filed Jan. 11, 2013, which is herein incorporated by reference.

STATEMENT OF GOVERNMENT SUPPORT

This invention was made with government support under Contract No. DE-AC02-05CH11231 awarded by the U.S. Department of Energy. The government has certain rights in this invention.

TECHNICAL FIELD

This disclosure is related to carbon fiber, and more specifically to carbon fiber that is converted to boron nitride.

BACKGROUND

Currently, there are few ways to tune the conductivity of carbon fiber. Most of the methods involve high temperature heat treatments and chemical modification of the core of the carbon fiber, which may result in a large degree mechanical degradation of the carbon fiber and may change the conductivity by about a factor of two or less.

Further, for oxidation resistance, carbon fiber may be coated with silica or another ceramic. This is needed, in some applications, to incorporate carbon fiber into ceramic or metal matrices to form high strength composites. Some processes for coating carbon fiber with a ceramic involve expensive precursors that result in a factor of about 100 increase in the price of the processed fiber. Also, some of the ceramic coatings are epitaxial and of a very different lattice structure than the underlying carbon fiber.

SUMMARY

Disclosed herein is a new material or structure, boron nitride converted carbon fiber. The carbon fiber may be partially or completely converted to boron nitride. Also disclosed herein are methods and apparatus for converting carbon fiber to boron nitride.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

DETAILED DESCRIPTION

Figure 1:
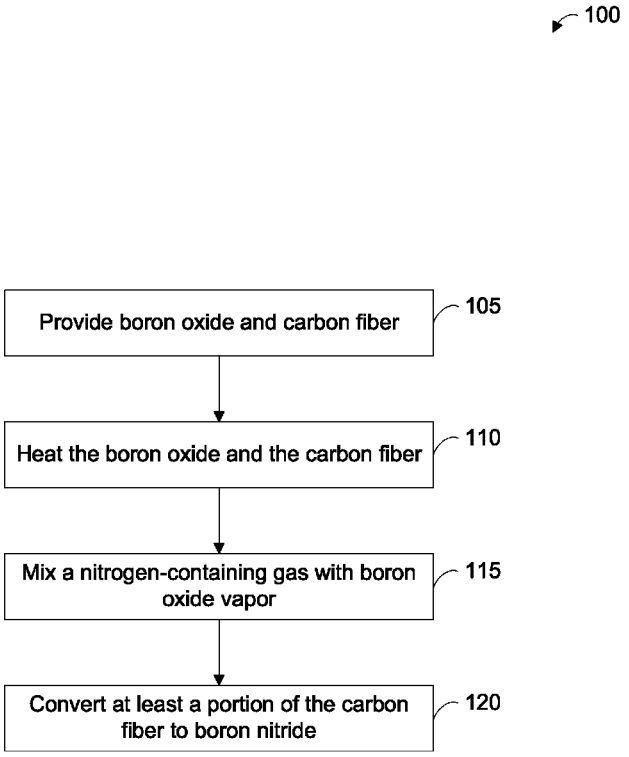
FIG. 1 shows an example of a flow diagram illustrating a process for converting carbon fiber to boron nitride.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

Introduction

Currently, there are no known methods for the conversion of carbon fiber to boron nitride. Current processes for the coating of boron nitride onto carbon fiber involve expensive and toxic precursors, mostly boron halides (e.g., $BCl_3$), for example. Processes for the direct production of boron nitride fiber also can involve expensive and rare precursors. The processes disclosed herein are both inexpensive and do not involve any dangerous compounds. The processes are also applicable to any form of carbon fiber currently available on the market (e.g., pitch-based carbon fiber, polyacrylonitrile-based (PAN-based) carbon fiber, graphitic carbon fiber, and chemical vapor deposition (CVD) grown carbon fiber). Boron nitride converted carbon fiber may facilitate the incorporation of carbon fiber into existing industrial processes.

One way in which boron nitride converted carbon fiber (as described herein) may be distinguished from boron nitride coated carbon fiber is that with boron nitride converted carbon fiber, the boron nitride layer may have the surface texture and morphology of the original carbon fiber. Boron nitride converted carbon fiber also may have a more uniform thickness boron nitride layer than the boron nitride coating on boron nitride coated carbon fiber.

Method

The conversion of graphitic carbon to hexagonal boron nitride can be performed by the so-called "carbothermal" process. While not wanting to be bound to any theory, the carbothermal process net reaction for converting carbon, including carbon fiber, to boron nitride is:

$$3C+B_2O_3+N_2 \rightarrow 3CO+2BN$$

Any intermediate reactions that may occur are not known.

In some embodiments, the conversion of a carbon fiber or a portion of a carbon fiber to boron nitride may be considered a vapor phase reaction; e.g., a vapor-phase carbothermal reduction with boron oxide.

In some embodiments, the process may convert the entire carbon fiber to boron nitride. In some embodiments, the outer layer of the carbon fiber may be converted to boron nitride.

FIG. 1 shows an example of a flow diagram illustrating a process for converting carbon fiber to boron nitride. In operation 105 of a method 100, boron oxide and carbon fiber are provided. In some embodiments, the carbon fiber may be in the form of individual carbon fibers or carbon fiber woven into a carbon fiber cloth or a carbon fiber mat.

In operation 110, the boron oxide is heated to melt the boron oxide and the carbon fiber is heated. In some embodiments, the boron oxide and the carbon fiber are separated from one another in operation 110; i.e., they are not mixed together, or in contact with one another. In some embodiments, the boron oxide and the carbon fiber are separated from one another throughout the method 100.

Boron oxide (e.g., diboron trioxide, $B_2O_3$) has a melting temperature of about 450° C. to 510° C., depending on the phase of the boron oxide. The boiling point of boron oxide is about 1860° C. In some embodiments, the boron oxide and the carbon fiber are heated to about 1000° C. to 2000° C. In some embodiments, the boron oxide and the carbon fiber are heated to about 1500° C. to 2000° C. In some embodiments, the boron oxide and the carbon fiber are heated to about 1400° C. to 1600° C. In some embodiments, the temperature of the boron oxide and the carbon fiber may not be the same. For example, depending on the configuration of the device used to heat the boron oxide and the carbon fiber and the positions of the materials, there may be a temperature difference of about 200° C. or at least about 200° C. between the boron oxide and the carbon fiber. In some embodiments, the boron oxide may be at a lower temperature (e.g., about 200° C. lower or at least about 200° C. lower) than the temperature of the carbon fiber.

In operation 115, a nitrogen-containing gas is mixed with boron oxide vapor from molten boron oxide. In some embodiments, the nitrogen-containing gas may be nitrogen or include nitrogen.

In operation 120, at least a portion of the carbon fiber is converted to boron nitride. For example, in some embodiments, the carbon fiber may have a substantially circular-cross section. The portion of the carbon fiber converted to boron nitride may include the portion of the carbon fiber proximate a perimeter of the substantially circular cross-section. In some embodiments, substantially all of the carbon fiber or the entire carbon fiber may be converted to boron nitride.

In some embodiments, the thickness of the boron nitride layer may be controlled by the temperature to which the boron oxide and the carbon fiber are heated, the pressure of the boron oxide vapor and nitrogen, and time period for which operations 110, 115 and 120 occur. In some embodiments, the conversion process may be performed at about 150 mbar to 1.5 bar. In some embodiments, the conversion process may be performed at about atmospheric pressure (i.e., about 1 bar) or slightly above atmospheric pressure. The partial pressure of boron oxide is determined by the temperature of the boron oxide. The partial pressure of boron oxide may be about 300 mbar, and the partial pressure of nitrogen may be about 700 mbar (i.e., a partial pressure ratio of about 1 mbar boron oxide to 2 mbar of nitrogen).

In some embodiments, to achieve a thinner boron oxide layer, the temperature may be about 1400° C., the partial pressure of boron oxide may be about 100 mbar, and the partial pressure of nitrogen may be about 200 mbar (i.e., a total pressure of about 300 mbar). In some embodiments, the pressure may be lower than about 300 mbar. In some embodiments, a ratio of the partial pressure of the boron oxide to the partial pressure of nitrogen may be about 1 to 2.

In some embodiments, operations 110, 115, and 120 occur over a time period of about 30 minutes to 120 minutes. For example, in some embodiments, the boron oxide and the carbon fiber may be heated (operation 110) and a nitrogen-containing gas mixed with boron oxide vapor (operation 115), with these two operations occurring substantially throughout the conversion process (operation 120).

In some embodiments, instead of using boron oxide, a different boron-containing material may be used. For example, one boron-containing material is boric acid. In embodiments in which a boron-containing material other than boron oxide is used, ammonia or another nitrogen-containing gas may be used.

The methods disclosed herein could be used to improve the oxidation resistance of the carbon fiber and/or to adjust or alter the conductivity of the carbon fiber. Further, the methods could be used to change the color of carbon fiber; there are currently no other methods that may be used to change the color of carbon fiber, which is black. By varying the thickness of the boron nitride layer, the original carbon fiber can be made any color desired. While not wanting to be bound by theory, one reason for the boron nitride converted carbon fiber changing color and boron nitride coated carbon fiber not reported as changing color is that that boron nitride coating on boron nitride coated carbon fiber may not have a uniform thickness or may not coat the carbon fiber completely.

Figure 2:
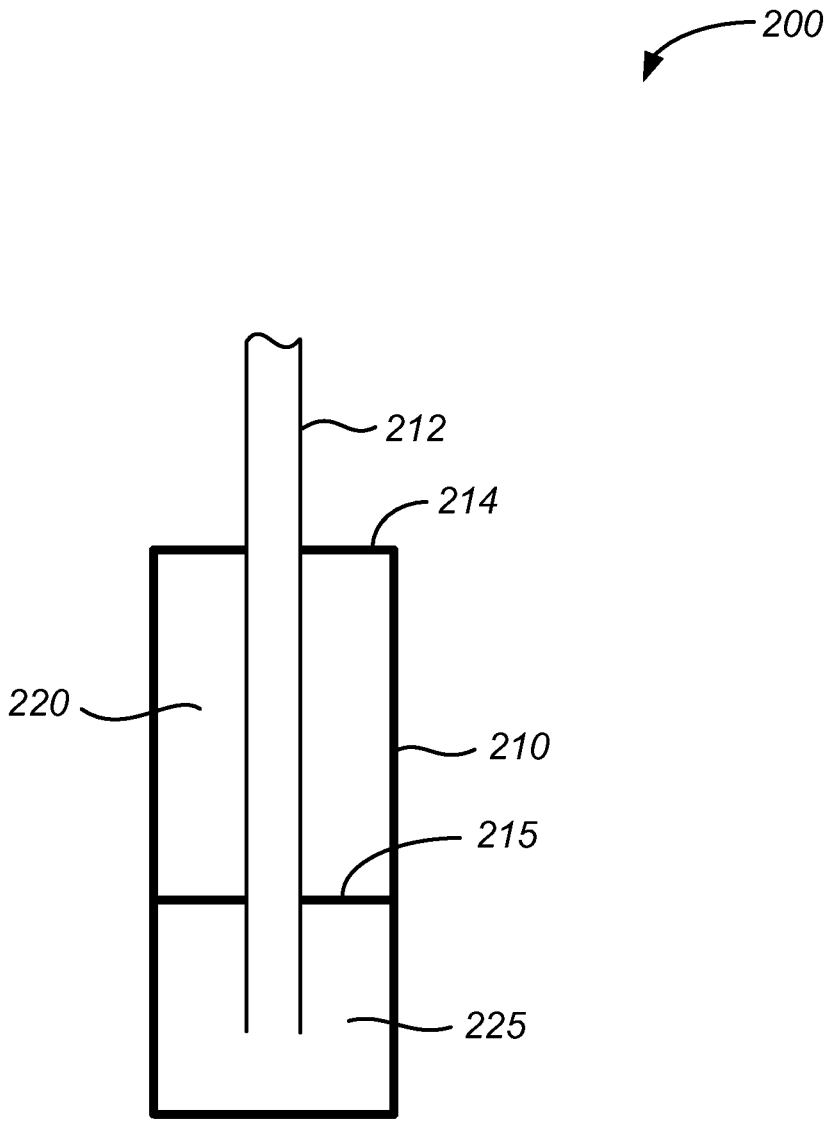
FIG. 2 shows an example of a cross-sectional schematic illustration of an apparatus for converting carbon fiber to boron nitride.

FIG. 2 shows an example of a cross-sectional schematic diagram of an apparatus for converting carbon fiber to boron nitride. The apparatus 200 includes a quartz tube (not shown) and a graphite crucible 210. A tube 212 is attached to a cover 214 or lid of the graphite crucible 210. In some embodiments, the tube 212 may be a graphite tube. In some embodiments, a top portion of the tube 212 may be alumina, and a portion of the tube 212 proximate the cover 214 and inside the graphite crucible 210 may be graphite.

As shown in FIG. 2, in some embodiments, the graphite crucible 210 includes a graphite plate 215 that separates the graphite crucible 210 into an upper portion 220 and a lower portion 225. The graphite plate 215 includes holes or ports (not shown) that allow a gas introduced through the tube 212 to flow out of the lower portion 225 and into the upper portion 220 of the graphite crucible 210. Further, the cover 214 or the upper portion 220 of the graphite crucible 210 may include holes or ports (not shown) that allow a gas to exit the graphite crucible 210.

In some other embodiments, the graphite crucible 210 may not include a graphite plate 215. An upper portion 220 of the graphite crucible 210 may have a larger inner diameter than a lower portion 225 of the graphite crucible 210. The difference in inner diameters may form a notch or a ledge on the inner surface of the graphite crucible 210; coiled-up or rolled-up carbon fiber (e.g., in the form of a mat) may be placed on this notch or ledge. For example, a mat of carbon fiber may be rolled into a cylinder slightly smaller than the inner diameter of the upper portion 220 of the graphite crucible 210. The rolled up carbon fiber mat may then be placed in the graphite crucible, where it may come into contact with the inner diameter of the graphite crucible and sit on the ledge or notch separating the top and bottom portions.

To use the apparatus 200, boron oxide may be placed in the lower portion 225 of the graphite crucible 210 and carbon fiber may be placed in the upper portion 220 of the graphite crucible 210. In some embodiments, the boron oxide and the carbon fiber may then be heated with a heat source (e.g., induction heating with a coil or a resistively heated furnace). In some embodiments, two heat sources may be used. Two heat sources may allow for the independent control of the temperature of the boron oxide and the temperature of the carbon fiber. In some embodiments, the graphite crucible may be wrapped with insulation, such as graphite felt insulation, for example. The insulation may aid in achieving and maintaining a temperature needed for converting the carbon fiber to boron nitride.

A nitrogen-containing gas may be flowed into the graphite crucible 210 though the tube 212. In some embodiments, the tube 212 extends into the lower portion 225 of the graphite crucible 210, proximate to a surface of the molten boron oxide. The nitrogen-containing gas may mix with boron oxide vapor from the molten boron oxide, flow past the heated carbon fiber in the upper portion 220 of the graphite crucible 210, and then flow out of the graphite crucible 210.

In some embodiments the quartz tube may have an inner diameter of about 4 inches. In some embodiments, the graphite crucible 210 may have an outer diameter of about 2 inches and a height of about 4 to 5 inches. Thus, the apparatus 200 may be used to convert small amounts of carbon fiber to boron nitride. When using the apparatus 200 to convert carbon fiber to boron nitride, the flow rate of the nitrogen, which controls the partial pressure of nitrogen, may be about 500 standard cubic centimeters per minute (sccm) to 1500 sccm. In combination with the temperature of the boron oxide and the carbon fiber and the dimensions of the graphite crucible, the nitrogen flow rate may be changed to modify the conversion process.

The methods disclosed herein and the method of using a graphite crucible to form boron nitride converted carbon fiber are scalable. For an industrial process, the graphite crucible may be larger. For example, the graphite crucible may be about 2 feet in diameter, and an entire roll of carbon fiber may be converted to boron nitride using such a graphite crucible.

Other larger scale apparatus for converting carbon fiber to boron nitride are possible. For example, an apparatus may include two rolls, a feed roll and a collection roll. The feed roll and the collection roll may function to pass a number of carbon fibers or a carbon fiber cloth over a reservoir or container of molten boron oxide, while nitrogen is fed into the apparatus.

Material

The boron nitride converted carbon fiber disclosed herein differs from boron nitride coated fiber in that the existing skin or outside layer or layers of the carbon fiber are directly converted to boron nitride; in boron nitride coated carbon fiber, an epitaxial layer of boron nitride is coated onto or adhered to carbon fiber. The methods disclosed herein can produce a fiber having a carbon core surrounded with a boron nitride shell or layer that is intimately coupled to the underlying carbon. In the case of PAN-based carbon fiber, the methods also preserve the original morphology and surface texture of the starting material; PAN-based carbon fiber is important commercially.

Figure 3:
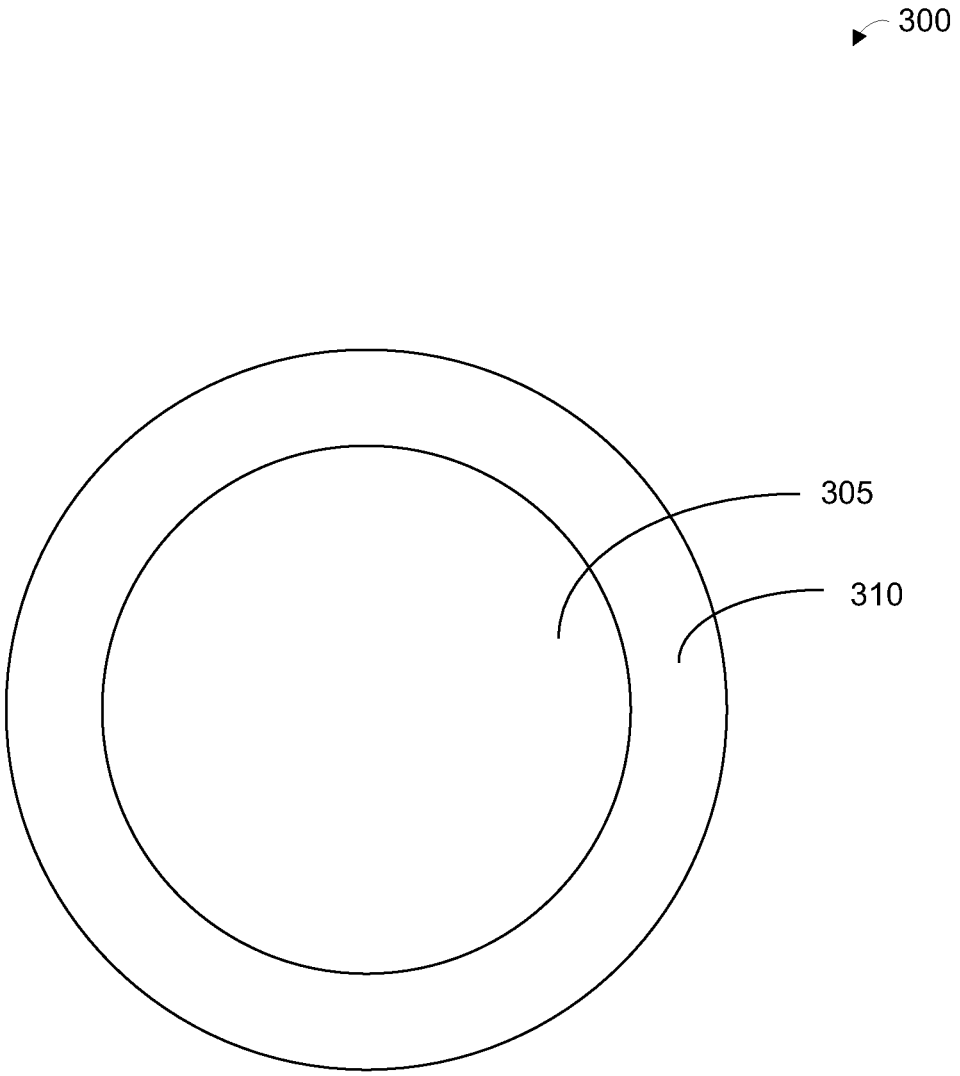
FIG. 3 shows an example of a cross-sectional schematic illustration of a boron nitride converted carbon fiber.

FIG. 3 shows an example of a cross-sectional schematic illustration of a boron nitride converted carbon fiber. The boron nitride converted carbon fiber 300 includes a carbon fiber core 305 and a boron nitride layer 310. The boron nitride layer 310 is not coated onto the carbon fiber core 305; instead, a portion of a carbon fiber is converted to boron nitride. Another way of stating this is that the boron nitride layer is produced by consuming a portion of the outer surface of a carbon fiber. Yet another way of stating this is that carbon is a necessary intermediate for the formation of the boron nitride layer.

Due to the conversion of carbon fiber into boron nitride, in some embodiments, the boron nitride layer 310 may have substantially the same morphology as the carbon fiber core 305. In some embodiments, the boron nitride layer 310 may have substantially the same morphology as the carbon fiber core 305 on a nanometer scale. In some embodiments, the surface of a boron nitride converted carbon fiber may have substantially the same surface features of the original carbon fiber.

In some embodiments, the carbon fiber core 305 may have a diameter of about 5 microns to 20 microns, or about 10 microns. In some embodiments, the thickness of the boron nitride layer may be about 10 nanometers to 1.5 microns, about 250 nanometers, or about 300 nanometers. In some embodiments, the boron nitride converted carbon fiber may be an individual fiber or fibers woven into cloth or a mat.

In some embodiments, the boron nitride layer is substantially pure boron nitride and the carbon fiber core is substantially pure carbon. In the boron nitride of boron nitride coated carbon fiber, there may be oxygen impurities; in some embodiments, in the boron nitride layer of boron nitride converted carbon fiber, there are substantially no oxygen impurities. In some embodiments, the transition from the boron nitride layer to the carbon fiber core may be a sharp transition; i.e., there may be little diffusion of the boron nitride into the carbon and carbon into the boron nitride. Thus, both the boron nitride layer and the carbon fiber core may be substantially pure, even in the region where the boron nitride layer is in contact with or adjacent to the carbon fiber core. In some embodiments, the boron nitride crystal lattice may match the crystal lattice of the carbon fiber core. In some embodiments, the microstructure of the boron nitride may be substantially the same as carbon fiber that was converted. In some embodiments, the boron nitride layer on boron nitride converted carbon fiber may have a substantially uniform thickness.

In some embodiments, a boron nitride layer on carbon fiber may change the color of the carbon fiber. The boron nitride layer may cause constructive interference upon reflection of visible light from the outer surface of the boron nitride layer and the surface of the carbon, resulting in different colors of the carbon fiber. The color of the carbon fiber is determined by the thickness of the boron nitride layer on the carbon fiber. In some embodiments, boron nitride converted carbon fiber may have a color selected from the group consisting of red, green, and blue. In some embodiments, boron nitride converted carbon fiber may have a color selected from the group consisting of red, green, blue, and variations thereof. In some embodiments, boron nitride carbon fiber may have a color other than black.

In some embodiments, a structure including a carbon fiber core and a boron nitride layer surrounding the carbon fiber core may be prepared by a process comprising the operations of providing boron oxide and carbon fiber, heating the boron oxide to melt the boron oxide and heating the carbon fiber, mixing a nitrogen-containing gas with boron oxide vapor from molten boron oxide, and converting at least a portion of the carbon fiber to boron nitride. In some embodiments, the boron nitride layer may have substantially the same morphology as the carbon fiber core.

The following descriptions of experiments are intended to be examples of the embodiments disclosed herein, and are not intended to be limiting. In one experiment, the outside 250 nanometers of 10 micron diameter carbon fiber was converted to boron nitride. Energy-dispersive X-ray spectroscopy (EDS) performed on the converted carbon fiber indicated that the surface was substantially pure boron nitride, while the core or central region of the carbon fiber remained substantially pure carbon.

Experiments converting carbon fiber to boron nitride were also performed with a number of different types of carbon fiber: PAN-based carbon fiber, pitch-based carbon fiber, and graphitic carbon fiber. The PAN-based carbon fiber was 6.1 microns to 7.2 microns in diameter, and the thickness of the boron nitride layer was 150 nm to 500 nm, depending on the processing conditions. In some experiments, the entire carbon fiber was converted to boron nitride. The pitch-based carbon fiber was 15 microns to 17 microns in diameter, and the thickness of the boron nitride layer was 400 nm to 1300 nm, depending on the processing conditions. The graphitic carbon fiber was 13 microns to 17 microns in diameter, and the thickness of the boron nitride layer was 130 nm to 500 nm, depending on the processing conditions.

Applications

One enhancement of some boron nitride converted carbon fiber over available products is the increase in oxidation resistance, from about 600° C. for carbon fiber to about 1000° C. for the boron nitride converted carbon fiber. Oxidation resistance may be needed for the incorporation of carbon fiber into composites, particularly ceramic and metal matrix composites. The potential for a reduction in cost may make boron nitride converted carbon fiber an attractive alternative to existing oxidation resistant fiber, such as silica-coated carbon fiber, for example.

The conversion of carbon to boron nitride on the surface of a carbon fiber also may be of interest to the aerospace and nuclear industries, owing to the high cross section of $^{10}B$ for neutron capture. These industries currently use boron nitride along with other boron-containing compounds to this end. The enhanced structural stability of boron nitride converted carbon fiber may allow for the incorporation of such neutron-capturing materials directly into a structural framework, saving on material cost and weight.

Boron nitride converted carbon fiber also provides a novel surface chemistry which may be beneficial to incorporating carbon fiber into new matrix materials. For example, in the case of metal matrices, the boron nitride layer of boron nitride converted carbon fiber may reduce or prevent diffusion of carbon into the metal matrix, which may preserve its strength and chemical composition.

Boron nitride converted carbon fiber may also be used as a high temperature insulated wire, with the carbon fiber being the conductive portion of the insulated wire and the boron nitride being the insulating portion of the insulated wire.

Further, colored versus black carbon fiber may be of interest to product designers in the production of consumer goods.

CONCLUSION

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. A method comprising:

(a) providing boron oxide and carbon fiber, the carbon fiber having a circular cross-section;

(b) heating the boron oxide to melt the boron oxide and heating the carbon fiber;

(c) mixing a nitrogen-containing gas with boron oxide vapor from molten boron oxide; and (d) converting a portion of the carbon fiber proximate a perimeter of the circular cross-section of the carbon fiber to boron nitride, the boron nitride having a thickness of about 10 nanometers to 1.5 microns.

2. The method of claim 1, wherein the boron oxide and the carbon fiber are heated to about 1000° C. to 2000° C.

3. The method of claim 1, wherein the boron oxide and the carbon fiber are heated to about 1500° C. to 2000° C.

4. The method of claim 1, wherein the carbon fiber is heated to a higher temperature than the boron oxide.

5. The method of claim 1, wherein operations (b), (c), and (d) occur over a time period of about 30 minutes to 120 minutes.

6. The method of claim 1, wherein the nitrogen-containing gas includes nitrogen.

7. The method of claim 1, wherein the nitrogen-containing gas includes nitrogen, and wherein a ratio of a partial pressure of boron oxide to a partial pressure of nitrogen is about 1 to 2 during operation (d).

8. The method of claim 1, wherein a pressure is about 1 bar during operation (d).

9. The method of claim 1, wherein the carbon fiber is in a form comprising a woven cloth including the carbon fiber.

10. The method of claim 1, wherein the boron oxide and the carbon fiber are separated from one another during operations (b), (c), and (d).

11. A structure comprising: a carbon fiber core; and a boron nitride layer surrounding the carbon fiber core, the boron nitride layer having the same surface morphology as the carbon fiber core, the boron nitride layer having a thickness of about 10 nanometers to 1.5 microns.

12. The structure of claim 11, wherein the boron nitride layer is not coated onto the carbon fiber core.

13. The structure of claim 11, wherein the carbon fiber core has a diameter of about 5 microns to 20 microns.

14. The structure of claim 11, wherein the boron nitride layer has a uniform thickness.

15. The structure of claim 11, wherein the structure has a color selected from a group consisting of red, green, blue, and variations thereof.

16. The structure of claim 11, wherein the structure has a color other than black.

17. A structure comprising: a carbon fiber core; and a boron nitride layer surrounding the carbon fiber core, the structure having a color selected from a group consisting of red, green, blue, and variations thereof, the color being determined by a thickness of the boron nitride layer.

18. The structure of claim 17, wherein the boron nitride layer causes constructive interference of visible light between an outer surface of the boron nitride layer and a surface the carbon fiber core.

19. The structure of claim 17, wherein the boron nitride layer has a thickness of about 10 nanometers to 1.5 microns.

20. The structure of claim 17, wherein the carbon fiber core has a diameter of about 5 microns to 20 microns.

* * * * *